US007063475B2

(12) United States Patent
Kirita et al.

(10) Patent No.: US 7,063,475 B2
(45) Date of Patent: Jun. 20, 2006

(54) INK-STORING BODY FOR WRITING UTENSIL

(75) Inventors: Kazuhisa Kirita, Fujioka (JP); Toshimi Kamitani, Fujioka (JP); Takao Koyama, Fujioka (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 233 days.

(21) Appl. No.: 10/487,712

(22) PCT Filed: Aug. 28, 2002

(86) PCT No.: PCT/JP02/08664

§ 371 (c)(1),
(2), (4) Date: Feb. 26, 2004

(87) PCT Pub. No.: WO03/020534

PCT Pub. Date: Mar. 13, 2003

(65) Prior Publication Data

US 2004/0228673 A1 Nov. 18, 2004

(30) Foreign Application Priority Data

Aug. 29, 2001 (JP) ..... 2001-259823

(51) Int. Cl.
*B43K 5/02* (2006.01)

(52) U.S. Cl. ..... 401/222

(58) Field of Classification Search ..... 401/198, 401/210, 222

See application file for complete search history.

(56) References Cited

U.S. PATENT DOCUMENTS 5,700,534 A * 12/1997 Shibazaki et al. ..... 401/198

FOREIGN PATENT DOCUMENTS

| | | | |
|---|---|---|---|
| JP | 9-141180 | A | 6/1997 |
| JP | 9-192582 | A | 7/1997 |
| JP | 10-192770 | A | 7/1998 |
| JP | 10-236065 | A | 9/1998 |
| JP | 2002-11989 | A | 1/2002 |
| JP | 2002-307890 | A | 10/2002 |

* cited by examiner

*Primary Examiner*—Tuan Nguyen
(74) *Attorney, Agent, or Firm*—Buchanan Ingersoll PC

(57) ABSTRACT

An ink reservoir for a Writing instrument molded from a gas barrier resin such as polyvinyl alcohol, an ethylene vinyl alcohol copolymer resin, polyacrylonitrile, polyamide, a cellulose resin, polyester, polycarbonate and polystyrene, wherein a vapor-scarcely permeable coating layer having a vapor permeability (P1) of 0.5 g/m$^2$* atm*24hr/25 μm or less at 40° and 90% RH is formed on the above reservoir for a writing instrument. In this ink reservoir for a writing instrument, a gas barrier property is not reduced under the environment of high moisture even if a wall of the ink reservoir is relatively thin and a resin having an excellent transparency is used, and releasing of pressurized air in the ink reservoir and falling of the tip member are not caused.

16 Claims, 3 Drawing Sheets

INK-STORING BODY FOR WRITING UTENSIL

TECHNICAL FIELD

The present invention, relates to an ink reservoir for a writing instrument molded from a gas barriering resin, more specifically to an ink reservoir for a writing instrument which is suited to free ink type writing instruments and which is excellent in a gas barriering property and a moisture absorption resistance and an ink reservoir for a writing instrument suited to a ballpoint pen refill of a so-called pressure type in which a part of the ink reservoir is charged with pressurized gas to pressurize the inside so that an ink is smoothly pushed out toward a direction of a ballpoint pen tip.

BACKGROUND ART

In general, an ink reservoir for a writing instrument molded from a gas barriering resin is used for writing instruments charged with a fragrant ink and a volatile ink for the purpose of maintaining fragrance and controlling volatilization of the inks.

A gas barriering resin used for this ink reservoir for a writing instrument has a hydrophilic group in a molecule thereof in many cases, and it is a hydrophilic resin, so that moisture absorption takes place due to moisture contained in the air and volatilization of moisture contained in an ink. As a result thereof, the problem that a gas barriering property and a mechanical strength are reduced is caused. In particular, it is known that the gas barriering property is exponentially reduced as moisture is absorbed.

Accordingly, when a hydrophilic gas barriering resin is used for members for a writing instrument, the outside thereof has to be covered with a hydrophobic resin such as polypropylene (PP) to cut off moisture contained in the air.

However, further addition of a molded holder member to the outsides of a holder and an ink reservoir of a writing instrument leads to an increase in the holder diameter and brings about the problem that the use feeling and the carrying property are reduced.

On the other hand, refills having various structures have so far been proposed for a ballpoint pen refill comprising an ink reservoir. Provided is, for example, a ballpoint pen refill of a so-called pressure type which is equipped with an ink reservoir and a ballpoint pen tip fixed at one side of this ink reservoir and in which a side opposite to the tip is tightly closed with a plug, wherein the tip side of the ink reservoir is charged with an ink, and the side opposite to the tip in the ink reservoir is charged with pressurized gas; and the ink is pushed out toward a direction of the tip by this pressurized gas.

In such ballpoint pen refill of a pressure type, a force to push out an ink toward a tip direction is always exerted on the ink due to a positive pressure state, and therefore writing is possible in the state that the tip is turned upward. Accordingly, back flow of an ink caused in writing in an upward state with a ballpoint pen refill of a non-pressure type in which a side opposite to the tip is opened is not caused in the ballpoint pen refill of a pressure type, and it is suited to writing with the tip turned upward in writing on paper adhered on a wall or writing while holding a clip board with a hand.

In order to maintain a pressure force over a long period of time in the ballpoint pen refill of a pressure type described above, a metal-made ink reservoir having a gas non-permeable wall is used or in a resin-made ink reservoir, measures are assumed so that the reservoir is increased in a thickness to prevent a reduction in a pressure force due to permeation of gas. However, in the metal-made ink reservoir, the inside of the ink reservoir can not be observed, and therefore a remaining amount of the ink can not be confirmed. Further, it has the defect that it is expensive. On the other hand, the resin-made ink reservoir has the advantage that an ink reservoir which is inexpensive and has a desired form is liable to be obtained. However, in order to raise the gas barriering property so that it can be used for a ballpoint pen refill of a pressure type, the reservoir has to be increased in a thickness, and therefore an ink remaining amount is less liable to be confirmed depending on the material. Further, there are the problems that freedom in designing the members is low and that shrinking and bending are liable to be caused.

Further, use of resins comprising an ethylene-vinyl alcohol copolymer, for example, an ethylene-vinyl alcohol copolymer, alloys or blends of the above copolymer with polyolefins or gas scarcely barriering resin compositions comprising a composite as a material for the resin-made ink reservoir makes it possible to decrease a thickness of the resin-made ink reservoir described above to some extent. A resin wall formed from a composition comprising these ethylene-vinyl alcohol copolymers can inhibit well gas permeation under dry environment, but under environment such as humidified atmosphere, the resin is swollen by moisture contained in the air, and the gas barriering property is reduced. In addition thereto, a dimensional change is caused, so that brought about are the problems that the tip on which a pressure force is always exerted is liable to fall out and that the ink is liable to leak.

DISCLOSURE OF THE INVENTION

In light of the problems on the conventional techniques described above, the present invention intends to solve them, and an object thereof is to provide an ink reservoir for a writing instrument such as a ballpoint pen refill which can prevent a gas barriering resin from absorbing moisture without increasing a holder diameter in a holder material for a writing instrument molded from the gas barriering resin and which is not reduced in a gas barriering property under environment of high humidity and does not cause releasing of pressurized air in the ink reservoir and falling of the tip member if a wall of the ink reservoir is relatively thin and a resin having an excellent transparency is used.

Intensive investigations on the conventional techniques described above repeated by the present inventors have resulted in finding that an ink reservoir for a writing instrument meeting the object described above, which is an ink reservoir for a writing instrument molded from a gas barriering resin, is obtained by forming a vapor-scarcely permeable coating layer having a specific characteristic on the above ink reservoir for a writing instrument, and they have further found that even if the wall of the reservoir is transparent and formed in a relatively thin thickness and gas in the above reservoir is left under any environment, gas is not readily released through the wall by using a gas barriering resin composition as a material for the ink reservoir and forming a vapor-scarcely permeable coating layer having a specific characteristic on the outside wall of the above reservoir and that obtained is an ink reservoir for a writing instrument in which a reservoir wall does not cause a dimensional change under high humidity and which is suited to a ballpoint pen refill of a so-called pressure type. Thus, they have come to complete the present invention.

That is, the present invention comprises the following items (1) to (15).

(1) An ink reservoir for a writing instrument molded from a gas barriering resin, wherein a vapor-scarcely permeable coating layer having a vapor permeability (P1) of 0.5 g/m$^2$*atm*24 hr/25 μm or less at 40° C. and 90% RH is formed on the above reservoir for a writing instrument.

(2) The ink reservoir for a writing instrument as described in the above item (1), wherein the gas barriering resin has an oxygen permeability of 100 ml/m$^2$*atm*24 hr/25 μm or less at 25° C. and 50% RH.

(3) The ink reservoir for a writing instrument as described in the above item (1) or (2), wherein the gas barriering resin has a vapor permeability of 10 g/m$^2$*atm*24 hr/25 μm or more at 40° C. and 90% RH.

(4) The ink reservoir for a writing instrument as described in any of the above items (1) to (3), wherein the gas barriering resin is at least one selected from the group consisting of polyvinyl alcohol, an ethylene vinyl alcohol copolymer resin, polyacrylonitrile, polyamide, a cellulose resin, polyester, polycarbonate and polystyrene.

(5) The ink reservoir for a writing instrument as described in any of the above items (1) to (4), wherein the vapor-scarcely permeable coating layer has a thickness falling in a range of 0.1 to 1000 μm.

(6) The ink reservoir for a writing instrument as described in any of the above items (1) to (5), wherein the vapor-scarcely permeable coating layer is formed from at least one selected from the group consisting of polyvinylidene chloride, polyolefin, a copolymer of vinylidene chloride and methyl methacrylate, chlorinated polyethylene, polytetrafluoroethylene and polyethylene trifluoride.

(7) The ink reservoir for a writing instrument as described in any of the above items (1) to (5), wherein the vapor-scarcely permeable coating layer is formed from waxes having an average molecular weight of 300 to 3000.

(8) The ink reservoir for a writing instrument as described in the above item (7), wherein the waxes are at least one selected from the group consisting of paraffin base wax, microcrystalline wax, petrolactum, fatty acids having a long-chain alkyl group, fatty acid amides and fatty acid metal salts.

(9) The ink reservoir for a writing instrument as described in the above item (7) or (8), wherein the vapor-scarcely permeable coating layer contains 1 to 30% by weight of a resin based on the waxes.

(10) The ink reservoir for a writing instrument as described in the above item (9), wherein the resin is at least one selected from the group consisting of polyacrylonitrile, polyamide, polyvinyl chloride, polyvinylidene chloride, polyester, polypropylene, polyethylene, polycarbonate, polystyrene, an ethylene vinyl acetate copolymer and polyvinyl acetate.

(11) The ink reservoir for a writing instrument as described in the above item (9) or (10), wherein the resin has a glass transition temperature of 10° C. or higher.

(12) The ink reservoir for a writing instrument as described in any of the above items (1) to (11), wherein the ink reservoir for a writing instrument comprises a cap-like or tubular cylinder which is charged with an oil base ink and in which one end is sealed and the other end is a discharge port of the above ink; the above cylinder is partially charged with gas in a pressure state in addition to the above oil base ink; the above cylinder comprises a gas barriering resin wall, and the vapor-scarcely permeable coating layer is formed on an outside wall of the above cylinder.

(13) The ink reservoir for a writing instrument as described in the above item (12), wherein the resin wall of the cylinder described above has a thickness falling in a range of 0.5 to 1.5 mm.

(14) A ballpoint pen refill comprising the ink reservoir for a writing instrument as described in the above item (12) or (13) and a ballpoint pen tip installed in the discharge port of the above ink reservoir.

(15) The ballpoint pen refill as described in the above item (14), wherein the ink reservoir at an end side to which the tip described above is installed is charged with an ink; the ink reservoir at the sealed end side described above is charged with gas in a pressure state; and the coating layer on the outside wall of the cylinder described above is formed so that a part of an outside wall of the tip described above is covered.

BEST MODE FOR CARRYING OUT THE INVENTION

Figure 1:
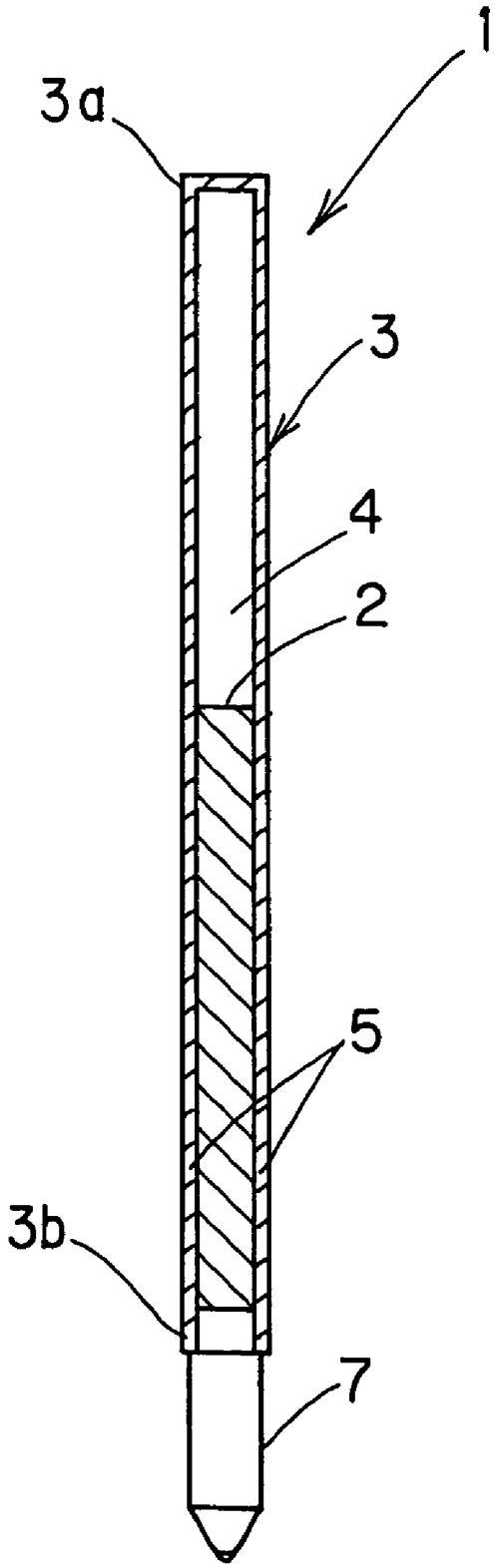
FIG. 1 is a schematic cross-sectional drawing of a ballpoint pen refill having the ink reservoir for a writing instrument according to the present invention.

The embodiment of the present invention shall be explained below in details. The ink reservoir for a writing instrument according to the present invention shall not be restricted to the following embodiments and examples.

The ink reservoir for a writing instrument according to the present invention is an ink reservoir for a writing instrument is molded from a gas barriering resin, and it is characterized by that a vapor-scarcely permeable coating layer having a vapor permeability (P1) of 0.5 g/m$^2$*atm*24 hr/25 μm or less at 40° C. and 90% RH is formed on the above reservoir for a writing instrument.

The ink reservoir for a writing instrument according to the present invention shall not specifically be restricted as long as it is an ink reservoir which can store an ink for a writing instrument, and capable of being given, are, for example, an ink reservoir for a free ink type writing instrument, a ballpoint pen refill and a pressure type ballpoint pen refill. Also, an ink stored in the ink reservoir shall not specifically be restricted as long as it is an ink stored in an ink reservoir, and an oil base ink and a water base ink can be given.

The gas barriering resin constituting the main body part (the members other than the coating layer) of the ink reservoir for a writing instrument according to the present invention is preferably constituted from a resin having an oxygen permeability of 100 ml/m$^2$*atm*24 hr/25 μm or less at 25° C. and 50% RH and a vapor permeability of 10 g/m$^2$*atm*24 hr/25 ∞m or less at 40° C. and 90% RH from the viewpoint of exhibiting an excellent gas barriering property and moisture absorption resistance.

The resin having such oxygen permeability and vapor permeability as described above includes a resin constituted from at least one (alone or a mixture of two or more kinds thereof, hereinafter the same shall apply) selected from the group consisting of polyvinyl alcohol, an ethylene*vinyl alcohol copolymer resin, polyacrylonitrile, polyamide (nylon and the like), a cellulose resin, polyester, polycarbonate and polystyrene.

The main body part constituted from this gas barriering resin has a thickness of preferably 1.5 mm or less, more preferably 0.5 to 1.5 mm in relation to a transparence and a strength thereof.

In the present invention, the vapor-scarcely permeable coating layer coated on the outside layer of the main body part of the ink reservoir for a writing instrument constituted from the gas barriering resin described above has to have a vapor permeability (P1) of 0.5 $g/m^2$*atm*24 hr/25 μm or less at 40° C. and 90% RH.

If the vapor permeability (P1) described above exceeds 0.5 $g/m^2$*atm*24 hr/25 μm at 40° C. and 90% RH, the gas barriering resin is swollen by moisture contained in the air under environment such as humidified atmosphere, and the gas barriering property is reduced. In addition thereto, the dimensional change is caused. Accordingly, it is not preferred. Further, brought about are the problems that the tip on which a pressure force is always exerted in a refill for a pressurized ballpoint pen is liable to fall out and that the ink is liable to leak.

The vapor permeability (P1) is preferably 0.1 $g/m^2$*atm*24 hr/25 μm or less at 40° C. and 90% RH from the viewpoint of exhibiting more excellent moisture absorption resistance.

The vapor-scarcely permeable coating layer having the characteristic described above in the present invention can be formed by dissolving at least one selected from the group consisting of polyvinylidene chloride, polyolefin, a copolymer of vinylidene chloride and methyl methacrylate, chlorinated polyethylene, polytetrafluoroethylene and polyethylene trifluoride each having the characteristic described above in a solvent and coating the solution on the main body part or sticking a film thereof on the main body part. Also, the coating layer can be formed by coating waxes having an average molecular weight (or a molecular weight, hereinafter referred to merely as "average molecular weight") of 300 to 3000 dissolved in a solvent on the main body part.

The waxes having an average molecular weight of 300 to 3000 described above include at least one selected from the group consisting of paraffin base wax, microcrystalline wax, petrolactum, fatty acids having a long-chain alkyl group, fatty acid amides and fatty acid metal salts.

If the waxes have an average molecular weight of less than 300, the effects of the present invention can not be displayed. On the other hand, if the average molecular weight exceeds 3000, they are not dissolved in a solvent, and therefore it is difficult to coat them on the main body part. Accordingly, both are not preferred.

Paraffin wax, calcium stearate, magnesium stearate and stearic acid amide can given be as the specific usable waxes having an average molecular weight falling in the range described above.

The coating face of the waxes is soft depending on the kind of the waxes, and therefore deformation and peeling of the waxes coating film are caused by abrasion and pressure to reduce a capability of preventing moisture absorption in a certain case. From the viewpoint of preventing such inconvenience, the waxes containing 1 to 30% by weight (hereinafter, merely called "%") of a resin based on the waxes described above are preferred.

The resin added to the waxes includes at least one selected from the group consisting of polyacrylonitrile, nylon, polyvinyl chloride, polyvinylidene chloride, polyester, polypropylene, polyethylene, polycarbonate, polystyrene, an ethylene*vinyl acetate copolymer and polyvinyl acetate. More preferred is the resin (among the resins described above, the resin having a relatively high molecular weight) having a glass transition temperature of 10° C. or higher.

If an addition amount of this resin is less than 1% based on the waxes, further modification of the waxes is unsatisfactory. On the other hand, if it exceeds 30%, a capability of preventing moisture absorption in the waxes is reduced. Accordingly, both are not preferred.

In the present invention, the vapor-scarcely permeable coating layer having the characteristic described above has a film thickness of preferably 0.1 to 1000 μm, more preferably 1 to 100 μm. If this film thickness is less than 0.1 μm, moisture absorption of the gas barriering resin can not effectively be suppressed. On the other hand, if this film thickness exceeds 1000 μm, the ink reservoir is reduced in transparency, and visibility of the ink is lowered.

Next, the preferred embodiment of a case in which the ink reservoir for a writing instrument according to the present invention is applied to a ballpoint pen refill shall be described in details with reference to the attached drawings.

Figure 2:
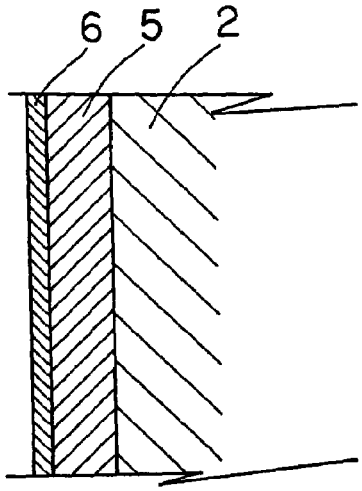
FIG. 2 is an enlarged cross-sectional drawing of a wall part of the ink reservoir shown in FIG. 1.
Figure 3A:
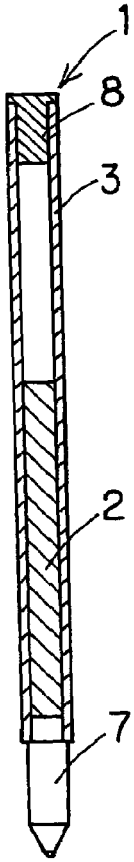
FIG. 3A to 3C are the respective schematic cross-sectional drawings of other ballpoint pen refills having the ink reservoir for a writing instrument according to the present invention.
Figure 3B:
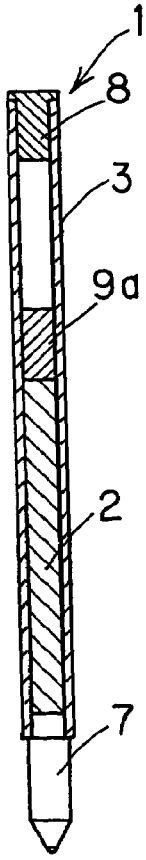
Figure 3C:
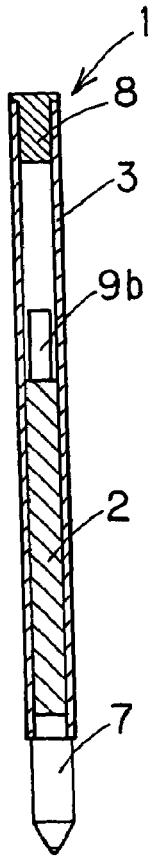
Figure 4:
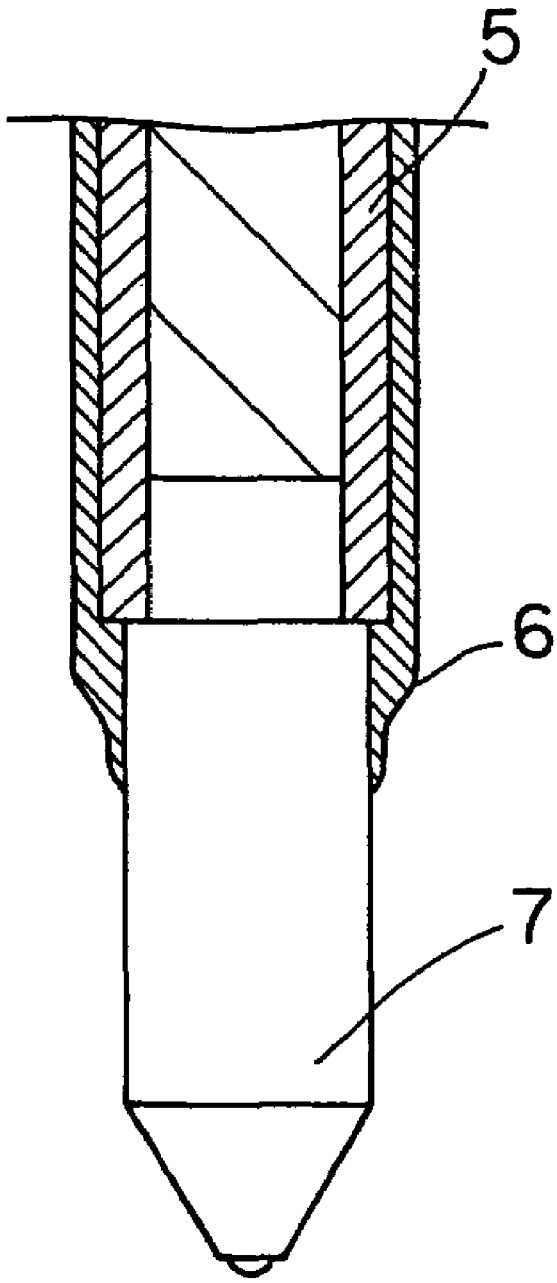
FIG. 4 is an enlarged cross-sectional drawing of a pen tip part of the respective ballpoint pen refills shown in FIG. 3.

FIG. 1 is a schematic cross-sectional drawing of a ballpoint pen refill having the ink reservoir for a writing instrument according to the present invention. FIG. 2 is an enlarged cross-sectional drawing of a wall part of the ink reservoir shown in FIG. 1. FIGS. 3A to 3C are the respective schematic cross-sectional drawings of other ballpoint pen refills having the ink reservoir for a writing instrument according to the present invention. FIG. 4 is an enlarged cross-sectional drawing of a pen tip part of the respective ballpoint pen refills shown in FIG. 3.

The ink reservoir for a writing instrument according to the present invention comprises, as shown in FIG. 1 to FIG. 4, a cap-like or tubular cylinder which is charged with an oil base ink 2 and in which one end 3*a* is sealed and the other end 3*b* is a discharge port of the above ink 2. In the ink reservoir 1 for a writing instrument, a cylinder 3 is partially charged with gas 4 in a pressure state in addition to the oil base ink 2; the cylinder 3 comprises a gas barriering resin wall 5 comprising the gas barriering resin described above, for example, an ethylene-vinyl alcohol copolymer as a component, and a vapor-scarcely permeable coating layer 6 is formed on the outside wall 5 of the cylinder.

The ink reservoir 1 for a writing instrument of the embodiments show in FIG. 1 and FIG. 3 is constituted as a ballpoint pen refill, and a ballpoint pen tip 7 is inserted and installed in a discharge port 3*b* of the cylinder 3. When the cylinder 3 is not cap-like, a plug is provided, as shown in FIGS. 3A to 3C, at one end 3*a* of the cylinder 3. The cylinder 3 is charged with gas, for example, air or nitrogen gas in a pressure state in addition to the oil base ink 2. Further, as shown in FIGS. 3B and 3C, a liquid follower 9*a* or a solid follower 9*b* is provided in the inside of the cylinder 3, and the oil base ink 2 is always unevenly distributed or situated at a ballpoint pen tip 7 side by virtue of the respective follower 9*a* and follower 9*b*.

This acts so that the ink 2 is pushed out toward a tip 7 directions by pressure of the gas 4.

Usually, the material of the cylinder 3 in the ink reservoir 1 is preferably formed from a gas non-permeable metal layer of aluminum and the like which does not completely or substantially permeate gas through a cylinder wall because pressurized gas is sealed therein. In such metal-made cylinder, however, there are the problems that an ink remaining amount can not be confirmed and that it is usually lacking in processing moldability as compared with resin molded articles and is expensive.

Then, the cylinder 3 (including the plug 8 described above in a certain case) in the ink reservoir for a writing instrument according to the present invention comprises the gas barriering resin wall 5 comprising a gas barriering resin, for example, an ethylene-vinyl alcohol copolymer as a component. If the material of the cylinder 3 is the gas barriering resin composition described above, provided are the advantages that molding processing is easy and an ink remaining amount in the inside can be confirmed and that the ink reservoir 1 which is inexpensive and has a desired shape can be obtained.

The gas barriering resin comprising the foregoing ethylene-vinyl alcohol copolymer as a component is an ethylene-vinyl alcohol copolymer, an alloy of the above copolymer with the other resins, a blend composition thereof or a composite containing these resin compositions, and the alloy or the blend is preferably an alloy or a blend composition with polyolefins. Eval F (manufactured by Kuraray Co., Ltd.) and an alloy (BPO-10A, manufactured by Kuraray Co., Ltd.) of an ethylene-vinyl alcohol copolymer and polyolefin can be given as the specific examples of such ethylene-vinyl alcohol copolymer.

In respect to the function of a gas scarcely permeating property of the ethylene-vinyl alcohol copolymer component described above, the oxygen permeability is preferably 1 ml*mm/$m^2$*24 hr*atm or less, particularly 0.1 ml*mm/$m^2$*24 hr*atm or less, wherein the oxygen permeability at a temperature of 23° C. is measured by a differential pressure method of JIS K 7126 in a resin thickness of 1 mm.

If a resin in which the oxygen permeability described above is 1 ml/$m^2$*24 hr*atm or less is used for the cylinder 3, a thickness of the resin wall 5 can be decreased to the utmost, and the transparency thereof can sufficiently be maintained, so that the ink remaining amount can readily be confirmed.

The foregoing oxygen permeability of the resin wall 5 itself in the cylinder 3 described above at a temperature of 23° C. is, though depending on the form of the cylinder 3 and the whole surface area thereof, usually 1 ml/$m^2$*24 hr*atm or less, particularly preferably 0.1 ml/$m^2$*24 hr*atm or less. The resin wall 5 in the cylinder 3 has a thickness of preferably 1.5 mm or less in relation to a transparency of the wall.

For example, when an ethylene-vinyl alcohol copolymer composition having a thickness of 1 mm and an oxygen permeability of 0.05 ml*mm/$m^2$*24 hr*atm at a temperature of 23° C. is used for the cylinder 3 and the ink reservoir 1 having a diameter of 6 mm, a length of 80 mm and a thickness of 1 mm is used in molding the cylinder 3, the oxygen permeating amount per day is $0.05\times1.5\times10^{-3}=7.5\times10^{-5}$ ml/24 hr, and this value is suited to a ballpoint pen refill of a pressure type.

In contrast with this, for example, polypropylene generally used for a ballpoint pen refill of an open type has an oxygen permeability of 60 to 100 ml*mm/$m^2$*24 hr*atm, and the permeating amount is fairly large, so that it is not suited to the ballpoint pen refill of an open type.

The resin wall 5 in the cylinder 3 described above comprises the gas barriering resin composition as described above but does not have to comprise a single layer containing these components, and it may be formed in a multilayer of the other different resin layers, for example, an olefin layer of polyethylene, polypropylene and the like.

The resin wall 5 in the cylinder 3 described above has the gas barriering property and may be a resin wall which is formed in a single layer or a multilayer, and particularly the resin wall 5 in the cylinder 3 described above has a thickness falling preferably in a range of 0.5 to 1.5 mm.

If the resin wall 5 in the cylinder 3 described above has a thickness of less than 0.5 mm, problems are likely to be brought about on a moldability and a mechanical strength thereof when the ink reservoir 1 is used as a ballpoint pen refill. On the other hand, if the foregoing resin wall 5 in the cylinder 3 has a thickness exceeding 1.5 mm, the transparency thereof is likely to be reduced by providing the resin wall 5 itself and the coating layer 6 described later, and a difficulty in confirming an ink amount remaining in the ink reservoir 1 and a reduction in design freedom may be brought about in a certain case.

Originally, the more the thickness of the resin wall 5 of the cylinder 3 in the ink reservoir 1 is increased, the more the gas barriering property is improved. In contrast with this, however, a difficulty in confirming an ink amount remaining in the ink reservoir 1 and a reduction in design freedom which are defects of the ink reservoir 1 having a too large thickness are likely to be brought about.

If the cylinder 3 has a thickness of 0.5 or more and 1.5 mm or less, a ballpoint pen refill of the embodiment having no inconveniences described above can more surely be obtained. On the other hand, if the cylinder 3 has a thickness of les than 0.5 mm, inconveniences in terms of the moldability and the ink reservoir strength are likely to be caused.

The vapor-scarcely permeable coating layer 6 is formed on the resin outside wall 5 of the cylinder 3 in the ink reservoir 1 for a writing instrument of the present embodiment.

Usually, the ethylene vinyl alcohol copolymer described above has a very excellent gas barriering property even by itself in a dry state, but the performance thereof is reduced under a humidifying condition. The resin wall 5 is swollen by vapor and lacking in a dimensional stability, and therefore an adverse effect is exerted on the refill performance.

In contrast with this, if the vapor-scarcely permeable coating layer 6 of the present invention is formed on the resin outside wall 5, the diffusion factor in penetration of vapor from the outside is considerably low than that in permeation through usual resins. Accordingly, vapor can be inhibited from being penetrating into the ink reservoir 1, and a gas barriering property of the resin wall 4 can be maintained.

When the coating layer described above is provided on the resin outside wall 5, it is preferably formed in the form of a coat layer from the viewpoint of the workability thereof, but it shall not be restricted thereto and may be formed by sticking a vapor-scarcely permeable film.

Any materials can be used as a material for the coating layer described above as long as they have a vapor-scarcely permeable property which can maintain the function of the resin wall 5 described above. In particular, a vapor-scarcely permeable material which provides a transparent wall and is less liable to permeate vapor is preferred rather than a vapor non-permeable material which comprises a metal layer of aluminum and the like providing a non-transparent wall and which does not substantially permeate vapor.

The vapor-scarcely permeable coating layer 6 described above has a vapor permeability (P1) of preferably 0.5 g/$m^2$*atm*24 hr/25 μm or less, particularly 0.1 g/$m^2$*atm*24 hr/25 μm or less at 40° C. and 90% RH. If the coating layer described above has a vapor permeability exceeding 0.5 g/m$^2$*atm*24 hr/25 μm, the resin wall 5 of the ink reservoir 1 is swollen by virtue of vapor contained in the air after long time passes to reduce a gas barriering property and cause a dimensional change. Accordingly, the tip 7 on which a pressure force is always exerted is liable to fall out, and the ink is likely to leak.

The specific examples of the vapor-scarcely permeable material described above include, as described above, a transparent resin layer having a high vapor barriering property such as polyvinylidene chloride, polyolefin, a copolymer of vinylidene chloride and methyl methacrylate, chlorinated polyethylene, polytetrafluoroethylene, polyethylene trifluoride, hydrochlorinated rubber, polyethylene and polypropylene, the wax layer described above and a layer which is a deposited layer of earth metals or metals such as aluminum, silicon, magnesium, titanium, silver and gold or oxides thereof and which has transparency to some extent. Particularly in the present invention, polyvinylidene chloride, polyolefin, a copolymer of vinylidene chloride and methyl methacrylate, chlorinated polyethylene, polytetrafluoroethylene and the wax layer described above are preferably used as the vapor-scarcely permeable material.

Also, such materials are dissolved in a solvent to prepare a solution or a latex, and it is coated on the resin wall 4 and dried, whereby the coating layer 6 described above can readily be obtained. Further, the coating layer can easily be obtained by coating a solution prepared by dissolving polyolefin in a hot toluene solution.

Accordingly, in the present embodiment, the coating layer 6 is provided at the outside of the resin wall 5 and/or the plug 8 so that the gas barriering performance of the resin wall 5 in the ink reservoir 1 or, if necessary, the plug 8 is not reduced. This coating layer 6 has to be (a) the coating layer 6 in which a single film comprising the same material as that of the coating layer 6 and having the same thickness T1 as that of the coating layer 6 has a vapor permeability of 0.5 g/m$^2$*atm*24 hr/25 μm or less at a temperature of 40° C. or (b) a coating layer in which P1 calculated from P1=P2*P3*T1/(P2(T1+T2)−P3*T2) is 0.5 g/m$^2$*atm*24 hr/25 μm or less, wherein a laminated film prepared by providing a coat comprising the same material as that of the coating layer 6 and having the same thickness T1 as that of the coating layer 6 on a resin film which comprises a different material from that of the coating layer 6 and has a thickness of T2 and which has a vapor permeability of P2 g/m$^2$*atm*24 hr/25 μm at a temperature of 40° C. has a vapor permeability of P3 g/m$^2$*atm*24 hr/25 μm at a temperature of 24° C.

The equation used in (b) described above shall be explained below in details.

Supposing that a permeability of a single film comprising a material A and having a thickness T1 is P1 and that a permeability of a single film comprising a material B and having a thickness T2 is P2, a permeability P3 of a double layer film obtained by laminating two kinds of these films usually has the following relation:

$$(T1+T2)/P3=T1/P1+T2/P2$$

To rearrange the foregoing equation for P1, $$P1=P2*P3*T1/(P2(T1+T2)-P3*T2)$$

Thus, a permeability can easily be obtained from the above equation even in a coating layer which is a single layer and comprises a material difficult to measure. As a result thereof, the same performance as the result measured in (a) is shown, and therefore both of (a) and (b) show the coating layer having a vapor permeability of 0.5 g/m$^2$*atm*24 hr/25 μm or less.

The coating layer 6 described above has a thickness of preferably 0.1 to 1000 μm, particularly 5 to 100 μm. It is more preferably 2 to 80 μm.

If the coating layer described above has a thickness falling in a range of 0.1 to 1000 μm, an influence exerted by vapor outside the ink reservoir can more surely be prevented. If the coating layer described above has a thickness exceeding 1000 μm, the ink reservoir is increased in a wall thickness by the coating layer, and a reduction in design freedom is likely to be brought about.

That is, controlling the thickness of the coating layer 6 described above in the range (0.1 to 1000 μm, preferably 5 to 100 μm) described above makes it possible to more surely prevent vapor from penetrating into the resin wall 5 layer in the cylinder 3 from the coating layer 6 described above and makes it possible to prevent the resin wall 5 from being swollen by vapor contained in the air even after long time passes to reduce the gas barriering property and cause a reduction in the dimensional change.

In the foregoing ballpoint pen refill, if a thickness of the coating layer 6 described above is reduced to less than 0.1 μm, the thin layer or film is likely to make it impossible to prevent vapor from penetrating into the resin wall 6 or into the plug in a certain case from the coating layer 5 described above by pin holes produced, a reduction in a mechanical strength of the layer of film and a reduction in the abrasion resistance. On the other hand, if the thickness of the coating layer 6 described above exceeds 1000 μm, the whole cylinder 3 wall is thick in terms of a design, and a reduction in a transparency of the wall of the ink reservoir 1 and an increase in a dimension of the ink reservoir 1 and, in a certain case, the plug are brought about, so that the design freedom is likely to be reduced.

The gas 4 contained in the cylinder 4 described above shall not specifically be restricted as long as it does not damage the physical properties of the ink, and it is preferably air or nitrogen.

Setting the kind of the gas 4 charged into the ink reservoir 1 described above to air or nitrogen makes it possible to more surely prevent the gas from permeating in combination with the resin material of the cylinder described above.

That is, a material having less oxygen permeability is selected, as described above, for the resin material of the cylinder 3 and, in a certain case, the plug in the ink reservoir 1. On the other hand, pressurized gas which can be used safely at a low cost includes air, nitrogen and carbon dioxide. It is known that a gas permeating amount of plastics has a smaller value in order of carbon dioxide>oxygen>nitrogen. Accordingly, if either of air and nitrogen is used for the pressurized gas 4 contained in the cylinder 3 in the ballpoint pen refill of a pressure type, the gas 4 can more surely be prevented from penetrating from the resin wall 5, and the ink reservoir 1 is avoided from decreasing in pressure due to gas permeation. Thus, the ink reservoir 1 can be obtained at a lower cost.

Further, to explain selection of the gas described above, the performance of the gas permeability is calculated in a certain case using a permacoal value π (cal/ml), and this value is applied particularly to plastic films.

That is, $$\pi=71\{ln(\delta^2/fv)-5.7\}$$

wherein δ (cal/ml) is an aggregation energy density of a polymer; fv is a free volume ratio; and π is a permacoal value, and using this π, the gas permeability P is $A*e^{-s}\pi$. A and S in the above equation are intrinsic values depending on gas, and A (ml*cm/cm$^2$*sec*cmHg) and S are shown in the following Table 1

TABLE 1

| Gas | A (ml * cm/cm$^2$ * sec * cmHg) | S |
|---|---|---|
| Oxygen | $5.0 \times 10^{-9}$ | 0.112 |
| Nitrogen | $2.0 \times 10^{-9}$ | 0.120 |
| Carbon dioxide | $3.2 \times 10^{-8}$ | 0.122 |

Accordingly, oxygen or nitrogen reduces, as described above, a decrease in the pressure in the ink reservoir 1 due to gas permeation, and the ink reservoir 1 can be produced at a lower cost.

As shown in FIG. 1 and FIG. 3, the ballpoint pen refill comprising the ink reservoir 1 for a writing instrument and the ballpoint pen tip 7 installed in the discharge pot of the above reservoir 1 was explained in the embodiment described above.

In the ballpoint pen refill, the ink reservoir 1 at an installing end side of the tip 7 described above is charged with the ink 4, and the ink reservoir 1 at the sealing end side thereof is charged with the gas 4 in a pressure state. In this case, the coating layer 6 on the cylinder 3 outside wall is preferably formed so that it covers a part of the tip 7 outside wall described above.

In the ink reservoir 1 for a writing instrument according to the present invention, the vapor-scarcely permeable coating layer 6 is provided on the resin outside wall 5 of the cylinder 3 having less oxygen permeability, and in the case of an ordinary ink reservoir 1 for a writing instrument, this can sufficiently achieve the object. However, when it is used for a ballpoint pen refill for mass production, particularly when it is produced using an automatic assembling machine, fine scratches are produced on an engage part of the ink reservoir 1 and the tip 7 in pressing a ballpoint pen tip, and the inconvenience that the ink leaks from a gap thereof is likely to be caused.

In this case, a coat layer is formed as the coating layer 6 described above after assembling. The ink is filled into a tip 7 side at the other end 3*b* of the cylinder 3 in the ink reservoir 1, and pressurized gas is filled into one end 3*a* of the cylinder 3 described above; after the ballpoint pen tip is installed, the coat layer which is the coating layer described above is formed, and it is coated as well on a base end side of the ballpoint pen tip in a range where the coat layer does not exert an influence on writing, whereby the coat layer is formed so that it covers the scratches even if fine scratches are produced in assembling. This makes it possible to more surely maintain a gas tightness of the ink reservoir 1.

The coating layer according to the present invention limits only a vapor permeability, but scratch which is the subject of the present invention is fine, and the gas 4 in the inside of the ink reservoir and an ink 2 can be prevented as well from leaking from the fine scratches as described above.

The ink reservoir for a writing instrument such as a ballpoint pen refill was explained in the embodiment described above, but it does not have to be restricted to such ballpoint pen refill and can be applied as well to the other ink reservoirs for a writing instrument.

EXAMPLES

The ink reservoir for a writing instrument according to the present invention shall more specifically be explained with reference to examples. The ink reservoir for a writing instrument according to the present invention shall not be restricted to the following examples.

Examples 1 to 10, Reference Examples 1 and 2 and Comparative Examples 1 to 9

In Examples 1 to 10, Reference Examples 1 and 2 and Comparative Examples 1 to 9, resin compositions shown in the following Table 2 were molded into cylinders for ink reservoirs, and resin compositions shown in the following Table 3 were used to form coating layers by coating treatment.

TABLE 2

| | Cylinder material of ink reservoir | | | | |
|---|---|---|---|---|---|
| | Kind of resin | Thickness (mm) | Diameter (mm) | Length (mm) | Oxygen permeability (23° C., RH 0%) ml * mm/m$^2$ * 24 hr |
| Example 1 | EVOH | 0.5 | 6 | 80 | 0.05 |
| Example 2 | EVOH | 0.5 | 6 | 80 | 0.05 |
| Example 3 | EVOH | 1.0 | 6 | 80 | 0.05 |
| Example 4 | EVOH | 1.0 | 6 | 80 | 0.05 |
| Example 5 | EVOH | 0.5 | 6 | 80 | 0.05 |
| Example 6 | EVOH | 0.5 | 6 | 80 | 0.05 |
| Example 7 | EVOH | 1.0 | 6 | 80 | 0.05 |
| Example 8 | EVOH | 1.0 | 6 | 80 | 0.05 |
| Example 9 | EVOH | 1.5 | 6 | 80 | 0.05 |
| Example 10 | EVOH | 1.5 | 6 | 80 | 0.05 |
| Comparative Example 1 | PP | 1.0 | 6 | 80 | 85 |
| Comparative Example 2 | PP | 1.0 | 6 | 80 | 85 |
| Comparative Example 3 | PP | 1.0 | 6 | 80 | 85 |
| Comparative Example 4 | EVOH | 0.2 | 6 | 80 | 0.05 |
| Comparative Example 5 | EVOH | 3.0 | 6 | 80 | 0.05 |

TABLE 2-continued

| | Cylinder material of ink reservoir | | | | |
|---|---|---|---|---|---|
| | Kind of resin | Thickness (mm) | Diameter (mm) | Length (mm) | Oxygen permeability (23° C., RH 0%) ml * mm/m$^2$ * 24 hr |
| Comparative Example 6 | EVOH | 1.0 | 6 | 80 | 0.05 |
| Comparative Example 7 | EVOH | 1.0 | 6 | 80 | 0.05 |
| Comparative Example 8 | EVOH | 1.0 | 6 | 80 | 0.05 |
| Comparative Example 9 | EVOH | 0.2 | 6 | 80 | 0.05 |
| Reference Example 1 | EVOH | 1.0 | 6 | 80 | 0.05 |
| Reference Example 2 | EVOH | 1.5 | 6 | 80 | 0.05 |

In Table 2 shown above, the EVOH base material is manufactured by Nippon Gosei Chemical Ind. Co. Ltd., and the PP base material is manufactured by Mitsubishi Chemical Co. Ltd.

TABLE 3

| | Coat resin of ink reservoir | Vapor permeability (40° C., RH 90%) g/m$^2$ * atm * 24 hr/25 μm: Coat resin | Vapor permeability (40° C., RH 90%) g/m$^2$ * atm * 24 hr/25 μm: Cylinder resin | Vapor permeability P1(a) | Vapor permeability P2(b) |
|---|---|---|---|---|---|
| Example 1 | Cyclic polyolefin (*1) | 0.09 | 0.8 | 0.090 | 0.80 |
| Example 2 | Cyclic polyolefin (*1) | 0.09 | 0.8 | 0.090 | 0.80 |
| Example 3 | Cyclic polyolefin (*1) | 0.09 | 0.8 | 0.090 | 0.80 |
| Example 4 | Cyclic polyolefin (*1) | 0.09 | 0.8 | 0.090 | 0.80 |
| Example 5 | Vinylidene chloride (*2) | 0.05 | 0.8 | 0.050 | 0.80 |
| Example 6 | Vinylidene chloride (*2) | 0.05 | 0.8 | 0.050 | 0.80 |
| Example 7 | Vinylidene chloride (*2) | 0.05 | 0.8 | 0.050 | 0.80 |
| Example 8 | Vinylidene chloride (*2) | 0.05 | 0.8 | 0.050 | 0.80 |
| Example 9 | Vinylidene chloride (*2) | 0.05 | 0.8 | 0.050 | 0.80 |
| Example 10 | Vinylidene chloride (*2) | 0.05 | 0.8 | 0.050 | 0.80 |
| Comparative Example 1 | — | — | 0.3 | — | 0.01 |
| Comparative Example 2 | Polyethylene terephthalate (*4) | 1.00 | 0.3 | 1.000 | 0.30 |
| Comparative Example 3 | Chlorinate polyolefin (*3) | 1.20 | 0.3 | 1.200 | 0.30 |
| Comparative Example 4 | Chlorinate polyolefin (*3) | 1.20 | 0.8 | 1.200 | 0.80 |
| Comparative Example 5 | Chlorinate polyolefin (*3) | 1.20 | 0.8 | 1.200 | 0.80 |
| Comparative Example 6 | Chlorinate polyolefin (*3) | 1.20 | 0.8 | 1.200 | 0.80 |
| Comparative Example 7 | Polyethylene terephthalate (*4) | 1.00 | 0.8 | 1.000 | 0.80 |
| Comparative Example 8 | Chlorinate polyolefin (*3) | 1.20 | 0.8 | 1.200 | 0.80 |
| Comparative Example 9 | Chlorinate polyolefin (*3) | 1.20 | 0.8 | 1.200 | 0.80 |
| Reference Example 1 | Vinylidene chloride (*2) | 0.05 | 0.8 | 0.050 | 0.80 |
| Reference Example 2 | Vinylidene chloride (*2) | 0.05 | 0.8 | 0.050 | 0.80 |

In Table 3 shown above, polyolefin (*1) described above is a brand name APEL: manufactured by Mitsui Petrochemical Co., Ltd.; vinylidene chloride (*2) is a brand name Sun Latex L502: manufactured by Asahi Chemicals Ind. Co., Ltd.; chlorinate polyolefin (*3) is a brand name Supercron: manufactured by Nippon Seishi Co., Ltd.; and saturated polyester (*4) is a brand name Polyester TP290: manufactured by Nippon Gosei Kagaku Co., Ltd.

The respective ballpoint pen refills shown in the respective examples and comparative examples were assembled by charging a tip side of an ink reservoir with one g of an ink having the following composition, disposing a follower in a certain case so that it is situated on an ink surface at a side opposite to a tip and then charging with the ink, thereafter inserting the tip for a ballpoint pen in which a material of a ball is a super alloy and a material of a holder is a stainless steel and in which a diameter of a ball is 0.7 mm and then inserting a plug into the side opposite to the tip in the ballpoint pen refill while pressing the side opposite to the tip in the ballpoint pen refill by gas such as nitrogen and air at an absolute pressure of 0.3 MPa to seal the pressurized gas in the ballpoint pen refill.

| Ink composition: | |
|---|---|
| Benzyl alcohol (solvent) | 37.4% |
| Phenoxyethanol (solvent) | 1.5% |
| Oleic acid (additive) | 8.0% |
| Nigrosine (colorant) | 22.5% |
| Spiron Violet C-RH (colorant) | 9.0% |
| Spiron Yellow C-2GH (colorant) | 6.0% |
| Carbon black MA-100 (colorant * structural tackifier) | 8.0% |
| Hilac #111 (resin) | 5.4% |
| Polyvinylpyrrolidone K-90 (resin) | 0.8% |
| Aerosil 380 (structural tackifier) | 1.4% |

Next, all parts of the assembled ballpoint pen refill excluding the point part of the tip were subjected to dipping treatment in the foregoing resin solution for coating which was controlled to a prescribed concentration and then subjected to solvent removing treatment such as heat treatment to form a coating film. The structure thereof is shown in the following Table 4. A non-coating joint part (engage part) of the cylinder with the tip in the refill was designated as no coat layer after assembly.

The "film thickness" was calculated from a surface area of the base material and a specific gravity of the resin after measuring a weight change caused by the coating treatment.

TABLE 4

| | Film thickness of coat resin (T1) (μm) | Thickness (T1) of cylinder material resin (μm) | Vapor permeability (P3) (a + b) | Kind of pressurized gas pressure (MPa) | Presence of coat after assembly |
|---|---|---|---|---|---|
| Example 1 | 100 | 500 | 0.35 | Nitrogen (0.3) | Present |
| Example 2 | 42 | 500 | 0.50 | Nitrogen (0.3) | Present |
| Example 3 | 100 | 1000 | 0.47 | Nitrogen (0.3) | Present |
| Example 4 | 85 | 1000 | 0.49 | Nitrogen (0.3) | Present |
| Example 5 | 100 | 500 | 0.23 | Nitrogen (0.3) | Present |
| Example 6 | 21 | 500 | 0.50 | Nitrogen (0.3) | Present |
| Example 7 | 100 | 1000 | 0.34 | Nitrogen (0.3) | Present |
| Example 8 | 42 | 1000 | 0.50 | Nitrogen (0.3) | Present |
| Example 9 | 100 | 1500 | 0.41 | Nitrogen (0.3) | Present |
| Example 10 | 65 | 1500 | 0.49 | Nitrogen (0.3) | Present |
| Comparative Example 1 | — | 1000 | 0.08 | Nitrogen (0.3) | Present |
| Comparative Example 2 | 50 | 1000 | 0.31 | Nitrogen (0.3) | Present |
| Comparative Example 3 | 50 | 1000 | 0.31 | Nitrogen (0.3) | Present |
| Comparative Example 4 | 30 | 200 | 0.84 | Nitrogen (0.3) | Present |
| Comparative Example 5 | 30 | 3000 | 0.80 | Nitrogen (0.3) | Present |
| Comparative Example 6 | 100 | 1000 | 0.83 | Nitrogen (0.3) | Present |
| Comparative Example 7 | 100 | 1000 | 0.81 | Nitrogen (0.3) | Present |
| Comparative Example 8 | 20 | 1000 | 0.81 | Nitrogen (0.3) | Present |
| Comparative Example 9 | 20 | 200 | 0.83 | Nitrogen (0.3) | Present |
| Reference Example 1 | 1 | 1000 | 0.79 | Nitrogen (0.3) | Present |
| Reference Example 2 | 200 | 1500 | 0.29 | Nitrogen (0.3) | Present |

The ballpoint pen refills in which coating treatment was completed and which were confirmed to be able to write well by hand and had no defects on the coating films were subjected to the following evaluations. The results thereof are shown in the following Table 5.

In the test of "upward writing property", after assembling a pen, it was stored for one month under the environment of a temperature of 40° C. and 90% RH and then wrote by hand with a pen tip turned upward under the environment of a temperature of 25° C. and 65% RH.

Ten pieces of the ballpoint pen refills were evaluated for the "upward writing property".

(a) Could continuously write 500 m or more evaluation "○"

(b) Could continuously write 10 m or more and less than 500 m evaluation "Δ"

(c) Could continuously write less than 10 m evaluation "X"

In the test of "ink consumption rate", after assembling a pen, it was stored for one month under the environment of a temperature of 40° C. and 90% RH and then wrote until it could not write to determine a consumed ink amount W1, and the amount W1 was divided by an ink amount W0 which was charged at the beginning:

$$\text{consumption rate}=(W1/W0)\times 100$$

Ten pieces of the ballpoint pen refills were evaluated for the "ink consumption rate".

(a) Ink consumption rate 90% or more evaluation "○"

(b) Ink consumption rate 50% or more and less than 90% evaluation "Δ"

(c) Ink consumption rate less than 50% evaluation "X"

In the test of "ink leaking", after assembling a pen, it was stored for one month under the environment of a temperature of 40° C. and 90% RH, and then the ballpoint pen refill was visually observed and evaluated.

Ten pieces of the ballpoint pen refills were evaluated for the "ink leaking".

(a) Ink did not leak from the engage part of the ink reservoir with the tip evaluation "○"

(b) Ink was observed to leak very slightly from the engage part of the ink reservoir with the tip evaluation "Δ"

(c) Ink was observed to leak from the engage part of the ink reservoir with the tip evaluation "X"

In the test of "ink visibility", the ballpoint pen refill after assembling a pen was visually observed and evaluated.

The "ink visibility" was evaluated by observing by 100 persons.

(a) Visibility was good for 90 or more persons evaluation "○"

(b) Visibility was good for 89 to 50 persons evaluation "Δ"

(c) Visibility was good for 49 or less persons evaluation "X"

Ten pieces of the ballpoint pen refills were evaluated for the test of the "refill strength".

(a) Refill was not deformed and cracked, and pressurized gas and the ink did not leak even after a pressure of one kgf/cm$^2$ was applied to the central part of the refill evaluation "○"

(b) Refill was notably deformed, and pressurized gas and the ink were observed to leak very slightly after a pressure of one kgf/cm$^2$ was applied to the central part of the refill evaluation "Δ"

(c) Refill was broken and cracked, and pressurized gas and the ink were observed to leak after a pressure of one kgf/cm$^2$ was applied to the central part of the refill evaluation "X"

TABLE 5

| | Upward writing property (a) | Ink consumption rate (b) | Ink leaking (c) | Ink visibility (d) | Refill strength (e) |
|---|---|---|---|---|---|
| Example 1 | ○ | ○ | ○ | ○ | ○ |
| Example 2 | ○ | ○ | ○ | ○ | ○ |
| Example 3 | ○ | ○ | ○ | ○ | ○ |
| Example 4 | ○ | ○ | ○ | ○ | ○ |
| Example 5 | ○ | ○ | ○ | ○ | ○ |
| Example 6 | ○ | ○ | ○ | ○ | ○ |
| Example 7 | ○ | ○ | ○ | ○ | ○ |
| Example 8 | ○ | ○ | ○ | ○ | ○ |
| Example 9 | ○ | ○ | ○ | ○ | ○ |
| Example 10 | ○ | ○ | ○ | ○ | ○ |
| Comparative Example 1 | X | X | ○ | ○ | ○ |
| Comparative Example 2 | X | X | ○ | ○ | ○ |
| Comparative Example 3 | X | X | ○ | ○ | ○ |
| Comparative Example 4 | X | X | ○ | ○ | X |
| Comparative Example 5 | X | X | ○ | X | ○ |
| Comparative Example 6 | X | X | ○ | ○ | ○ |
| Comparative Example 7 | X | X | Δ | ○ | ○ |
| Comparative Example 8 | X | X | ○ | ○ | ○ |
| Comparative Example 9 | X | X | Δ | ○ | X |
| Reference Example 1 | X | X | ○ | ○ | ○ |
| Reference Example 2 | ○ | ○ | ○ | Δ | ○ |

It can be found from the results shown in Table 5 described above that the ballpoint pen refills prepared in Examples 1 to 10 are excellent in an upward writing property and an ink consumption rate, and it can be found that the ballpoint pen refills prepared in Comparative Examples 1 to 9 are deteriorated in an upward writing property and an ink consumption rate.

Also, the ink was observed to leak in Comparative Examples 7 and 9 in which the joint part or the engage part of the cylinder with the tip in the refill was not coated. Further, in Reference Example 1, a film thickness of the coat layer was too thin to observe the substantial effect of the coat layer, and an adverse effect was observed to be exerted on the upward writing property and the ink consumption rate. Also, in Reference Example 1, the ink visibility was a little deteriorated.

Examples 11 to 22 and Comparative Example 10

In Examples 11 to 22 and Comparative Example 10, resin compositions shown in the following Table 6 were used to mold cylinders for ink reservoirs, and coating liquids 1 to 12 of (1) to (4) prepared by the following methods using resin compositions shown in the following Table 7 were used to form waxes coating layers by coating treatment.

(1) Paraffin wax 150 (wax manufactured by Nippon Seiro Co., Ltd., average molecular weight: 458, hereinafter the same shall apply) was dissolved in xylene in proportions of 1%, 5%, 10% and 30% to prepare coating liquids 1, 2, 3 and 4 respectively.

(2) Calcium stearate (manufactured by Wako Pure Chemical Industries Ltd., average molecular weight: 607) was dissolved in xylene in proportions of 1%, 5%, 10% and 30% to prepare coating liquids 5, 6, 7 and 8 respectively.

(3) Paraffin Wax 150 was dissolved in xylene in a proportion of 5%, and Polyester TP-290 (manufactured by Nippon Gosei Kagaku Co., Ltd.) was added in proportions of 1%, 10%, 20% and 100% based on Paraffin Wax to prepare coating liquids 9, 10, 11 and 12 respectively.

TABLE 6

| | Cylinder material of ink reservoir | | | | |
|---|---|---|---|---|---|
| | Kind of resin | Thickness (mm) | Diameter (mm) | Length (mm) | Oxygen permeability (23° C., RH 0%) ml * mm/m$^2$ * 24 hr |
| Example 11 | EVOH | 1.0 | 6.0 | 80 | 0.05 |
| Example 12 | EVOH | 1.0 | 6.0 | 80 | 0.05 |
| Example 13 | EVOH | 1.0 | 6.0 | 80 | 0.05 |
| Example 14 | EVOH | 1.0 | 6.0 | 80 | 0.05 |
| Example 15 | EVOH | 1.0 | 6.0 | 80 | 0.05 |

TABLE 6-continued

| | Cylinder material of ink reservoir | | | | |
|---|---|---|---|---|---|
| | Kind of resin | Thickness (mm) | Diameter (mm) | Length (mm) | Oxygen permeability (23° C., RH 0%) ml * mm/m$^2$ * 24 hr |
| Example 16 | EVOH | 1.0 | 6.0 | 80 | 0.05 |
| Example 17 | EVOH | 1.0 | 6.0 | 80 | 0.05 |
| Example 18 | EVOH | 1.0 | 6.0 | 80 | 0.05 |
| Example 19 | EVOH | 1.0 | 6.0 | 80 | 0.05 |
| Example 20 | EVOH | 1.0 | 6.0 | 80 | 0.05 |
| Example 21 | EVOH | 1.0 | 6.0 | 80 | 0.05 |
| Example 22 | EVOH | 1.0 | 6.0 | 80 | 0.05 |
| Comparative Example 10 | EVOH | 1.0 | 6.0 | 80 | 0.05 |

In Table 6 described above, EVOH is manufactured by Nippon Gosei Kagaku Co., Ltd.

TABLE 7

| | Wax layer of ink reservoir | Vapor permeability (40° C., RH 90%) g/m$^2$ * atm * 24 hr/25 μm | | Vapor permeability | |
|---|---|---|---|---|---|
| | | Wax layer | Cylinder resin | P1(a) | P2(b) |
| Example 11 | Coating liquid 1 | 0.001 | 0.8 | 0.1 | 0.8 |
| Example 12 | Coating liquid 2 | 0.001 | 0.8 | 0.1 | 0.8 |
| Example 13 | Coating liquid 3 | 0.001 | 0.8 | 0.1 | 0.8 |
| Example 14 | Coating liquid 4 | 0.001 | 0.8 | 0.1 | 0.8 |
| Example 15 | Coating liquid 5 | 0.001 | 0.8 | 0.1 | 0.8 |
| Example 16 | Coating liquid 6 | 0.001 | 0.8 | 0.1 | 0.8 |
| Example 17 | Coating liquid 7 | 0.001 | 0.8 | 0.1 | 0.8 |
| Example 18 | Coating liquid 8 | 0.001 | 0.8 | 0.1 | 0.8 |
| Example 19 | Coating liquid 9 | 0.001 | 0.8 | 0.1 | 0.8 |
| Example 20 | Coating liquid 10 | 0.001 | 0.8 | 0.1 | 0.8 |
| Example 21 | Coating liquid 11 | 0.001 | 0.8 | 0.1 | 0.8 |
| Example 22 | Coating liquid 12 | 0.001 | 0.8 | 0.1 | 0.8 |
| Comparative Example 10 | — | 0.001 | 0.8 | 0.1 | 0.8 |

The respective ballpoint pen refills shown in the respective examples and comparative examples were assembled by charging a tip side of an ink reservoir with one g of an ink having the composition described above, disposing a follower in a certain case so that it is situated on an ink surface at a side opposite to a tip and then charging with the ink, thereafter inserting the tip for a ballpoint pen in which a material of a ball is a super alloy and a material of a holder is a stainless steel and in which a diameter of a ball is 0.7 mm and then inserting a plug into the side opposite to the tip in the ballpoint pen refill while pressing the side opposite to the tip in the ballpoint pen refill by gas such as nitrogen and air at an absolute pressure of 0.3 MPa to seal the pressurized gas in the ballpoint pen refill.

Next, all parts of the assembled ballpoint pen refill excluding the point part of the tip was subjected to dipping treatment in the foregoing coating liquid which was controlled to a prescribed concentration and then subjected to solvent removing treatment such as heat treatment to form a coating film. The structure thereof is shown in the following Table 8. A non-coating joint part (engage part) of the cylinder with the tip in the refill was designated as no coat layer after assembly.

TABLE 8

| | Film thickness of wax layer (T1) (μm) | Thickness (T1) of cylinder material resin (μm) | Vapor permeability (P3) (a + b) | Presence of coat after assembly |
|---|---|---|---|---|
| Example 11 | 0.1 | 1000 | 0.74 | Present |
| Example 12 | 0.6 | 1000 | 0.54 | Present |
| Example 13 | 1.6 | 1000 | 0.35 | Present |
| Example 14 | 6.4 | 1000 | 0.13 | Present |
| Example 15 | 0.1 | 1000 | 0.74 | Present |
| Example 16 | 0.8 | 1000 | 0.49 | Present |
| Example 17 | 1.8 | 1000 | 0.33 | Present |
| Example 18 | 7.0 | 1000 | 0.12 | Present |
| Example 19 | 0.6 | 1000 | 0.54 | Present |
| Example 20 | 0.7 | 1000 | 0.51 | Present |
| Example 21 | 0.7 | 1000 | 0.51 | Present |
| Example 22 | 1.2 | 1000 | 0.41 | Present |
| Comparative Example 10 | — | 1000 | 0.80 | Present |

The respective ballpoint pen refills in which coating treatment was completed and which were confirmed to be able to write well by hand and had no defects on the coating films were evaluated for an upward writing property, an ink consumption rate, ink leaking, an ink visibility and a refill strength by the respective evaluating methods described above. The results thereof are shown in the following Table 9.

The "average film thickness" was calculated from a surface area of the base material and a specific gravity of the resin after measuring a weight change caused by coating waxes.

TABLE 9

| | Upward writing property (a) | Ink consumption rate (b) | Ink leaking (c) | Ink visibility (d) | Refill strength (e) |
|---|---|---|---|---|---|
| Example 11 | ○ | ○ | ○ | ○ | ○ |
| Example 12 | ○ | ○ | ○ | ○ | ○ |
| Example 13 | ○ | ○ | ○ | ○ | ○ |

TABLE 9-continued

| | Upward writing property (a) | Ink consumption rate (b) | Ink leaking (c) | Ink visibility (d) | Refill strength (e) |
|---|---|---|---|---|---|
| Example 14 | ○ | ○ | ○ | ○ | ○ |
| Example 15 | ○ | ○ | ○ | ○ | ○ |
| Example 16 | ○ | ○ | ○ | ○ | ○ |
| Example 17 | ○ | ○ | ○ | ○ | ○ |
| Example 18 | ○ | ○ | ○ | ○ | ○ |
| Example 19 | ○ | ○ | ○ | ○ | ○ |
| Example 20 | ○ | ○ | ○ | ○ | ○ |
| Example 21 | ○ | ○ | ○ | ○ | ○ |
| Example 22 | ○ | ○ | ○ | ○ | ○ |
| Comparative Example 10 | X | X | ○ | ○ | ○ |

As apparent from the results shown in Table 9 described above, it can be found that the ballpoint pen refills prepared in Examples 11 to 22 are excellent in an upward writing property and an ink consumption rate, and it can be found that the ballpoint pen refill prepared in Comparative Example 10 is deteriorated in an upward writing property and an ink consumption rate.

INDUSTRIAL APPLICABILITY

As described above, a gas barriering property of the ink reservoir for a writing instrument according to the present invention is not reduced under the environment of high humidity, and the physical properties of an ink contained in the ink reservoir are stably maintained.

The ink reservoir for a writing instrument comprises a cap-like or tubular cylinder which is charged with an oil base ink and in which one end is sealed and the other end is a discharge port of the above ink; the above cylinder is partially charged with gas in a pressure state in addition to the above oil base ink; the above cylinder comprises a gas barriering resin wall, and a vapor-scarcely permeable coating layer is formed on an outside wall of the above cylinder. In such ink reservoir for a writing instrument, a gas barriering property is not reduced under the environment of high moisture even if a wall of the ink reservoir is relatively thin and a resin having an excellent transparency is used, and releasing of pressurized air in the ink reservoir and falling of the tip members are not caused.

What is claimed is:

1. An ink reservoir for a writing instrument molded from a gas barrier resin, wherein a vapor-scarcely permeable coating layer having a vapor permeability (P1) of 0.5 $g/m^2$*atm*24 hr/25 μm or less at 40° C. and 90% RH is formed on the above reservoir for a writing instrument.

2. The ink reservoir for a writing instrument as described in claim 1, wherein the gas barrier resin has an oxygen permeability of 100 $ml/m^2$*atm*24 hr/25 μm or less at 25° C. and 50% RH.

3. The ink reservoir for a writing instrument as described in claim 1, wherein the gas barrier resin has a vapor permeability of 10 $g/m^2$*atm*24 hr/25 μm or more at 40° C. and 90% RH.

4. The ink reservoir for a writing instrument as described in claim 1, wherein the gas barrier resin is at least one selected from the group consisting of polyvinyl alcohol, an ethylene-vinyl alcohol copolymer resin, polyacrylonitrile, polyamide, a cellulose resin, polyester, polycarbonate and polystyrene.

5. The ink reservoir for a writing instrument as described in claim 1, wherein the vapor-scarcely permeable coating layer has a thickness falling in a range of 0.1 to 1000 μm.

6. The ink reservoir for a writing instrument as described in claim 5, wherein the vapor-scarcely permeable coating layer is formed from at least one selected from the group consisting of polyvinylidene chloride, polyolefin, a copolymer of vinylidene chloride and methyl methacrylate, chlorinated polyethylene, polytetrafluoroethylene and polyethylene trifluoride.

7. The ink reservoir for a writing instrument as described in claim 1, wherein the vapor-scarcely permeable coating layer is formed from waxes having an average molecular weight of 300 to 3000.

8. The ink reservoir for a writing instrument as described in claim 7, wherein the waxes are at least one selected from the group consisting of paraffin base wax, microcrystalline wax, petrolactum, fatty acids having a long-chain alkyl group, fatty acid amides and fatty acid metal salts.

9. The ink reservoir for a writing instrument as described in claim 7, wherein the vapor-scarcely permeable coating layer contains 1 to 30% by weight of a resin based on the waxes.

10. The ink reservoir for a writing instrument as described in claim 9, wherein the resin is a resin having a glass transition temperature of 10° C. or higher.

11. The ink reservoir for a writing instrument as described in claim 11, wherein the resin is at least one selected from the group consisting of polyacrylonitrile, polyamide, polyvinyl chloride, polyvinylidene chloride, polyester, polypropylene, polyethylene, polycarbonate, polystyrene, an ethylene vinyl acetate copolymer and polyvinyl acetate.

12. An ink reservoir for a writing instrument molded from a gas barrier resin, wherein a vapor-scarcely permeable coating layer having a vapor permeability (P1) of 0.5 $g/m^2$*atm*24 hr/25 μm or less at 40° C. and 90% RH is formed on the above reservoir for a writing instrument, wherein the ink reservoir for a writing instrument comprises a cap-like or tubular cylinder which is charged with an oil base ink and in which one end is sealed and the other end is a discharge port of the above ink; the above cylinder is partially charged with gas in a pressure state in addition to the above oil base ink; the above cylinder comprises a gas barrier resin wall, and the vapor-scarcely permeable coating layer is formed on an outside wall of the cylinder described above.

13. The ink reservoir for a writing instrument as described in claim 12, wherein the resin wall of the cylinder described above has a thickness falling in a range of 0.5 to 1.5 mm.

14. A ballpoint pen refill comprising the ink reservoir for a writing instrument as described in claim 13 and a ballpoint pen tip installed in the discharge port of the above ink reservoir.

15. The ballpoint pen refill as described in claim 14, wherein the ink reservoir at an end side to which the tip described above is installed is charged with an ink; the ink reservoir at the sealed end side described above is charged with gas in a pressure state; and the coating layer on the outside wall of the cylinder described above is formed so that a part of an outside wall of the tip described above is covered.

16. A ballpoint pen refill comprising the ink reservoir for a writing instrument as described in claim 12 and a ballpoint pen tip installed in the discharge port of the above ink reservoir.

* * * * *